US011219261B1

(12) United States Patent
Thomas

(10) Patent No.: US 11,219,261 B1
(45) Date of Patent: Jan. 11, 2022

(54) CAP WITH APERTURE

(71) Applicant: Deirdra M. Thomas, Lewisville, TX (US)

(72) Inventor: Deirdra M. Thomas, Lewisville, TX (US)

( * ) Notice: Subject to any disclaimer, the term of this patent is extended or adjusted under 35 U.S.C. 154(b) by 150 days.

(21) Appl. No.: 16/547,835

(22) Filed: Aug. 22, 2019

(51) Int. Cl.
*A42B 1/22* (2006.01)

(52) U.S. Cl.
CPC ..... *A42B 1/225* (2013.01)

(58) Field of Classification Search
CPC ..... A42B 1/225; A42B 1/0182; A42B 1/06; A42B 1/004; A42B 1/22; A42B 1/201; A42B 1/205; A42B 1/206; A42B 7/00
USPC ..... 2/195.1
See application file for complete search history.

(56) References Cited

U.S. PATENT DOCUMENTS 5,170,509 A 12/1992 Leopold
5,321,854 A * 6/1994 Kronenberger ..... A42B 1/225 2/195.1
5,511,249 A 4/1996 Higgins
D370,334 S 6/1996 Stevenson et al.
D390,687 S 2/1998 Kazel
5,799,334 A 9/1998 Griffith et al.
D405,590 S 2/1999 Bartz
5,875,494 A * 3/1999 Garnier, Jr. ..... A42B 1/225 2/209.7
D424,282 S 5/2000 Crumpton et al.
D591,933 S 5/2009 Shirey
D692,213 S 10/2013 Brack
D697,288 S 1/2014 Pearson
9,210,960 B1 12/2015 Linn
D882,214 S * 4/2020 Yoo ..... A42B 1/225 D2/876
2004/0128739 A1* 7/2004 Tufano-Sisca ..... A42B 1/225 2/209.3
2008/0092272 A1* 4/2008 Vainio ..... A42B 1/225 2/209.7
2008/0201825 A1* 8/2008 Chun ..... A42B 1/225 2/209.13
2010/0162465 A1* 7/2010 Chen ..... A42C 5/02 2/181
2014/0130235 A1* 5/2014 Johnson ..... A42B 1/241 2/209.3
2019/0037951 A1* 2/2019 Rue ..... A42B 1/225
2019/0053560 A1* 2/2019 Yoo ..... A42B 1/225
2019/0365006 A1* 12/2019 Lim ..... A42B 1/225
2020/0305531 A1* 10/2020 Harry ..... A42B 1/225

FOREIGN PATENT DOCUMENTS

WO WO-2020082159 A1 * 4/2020 ..... A42B 1/225

* cited by examiner

*Primary Examiner* — Amy Vanatta
(74) *Attorney, Agent, or Firm* — Cramer Patent & Design, PLLC; Aaron R. Cramer

(57) ABSTRACT

A cap with an aperture at the top permits the hair of the wearer to protrude therethrough. Upon on side and back of the cap is a seam which permits the hat to be opened and secured about the head of the wearer. The seam on the side and back may be closed using a mating fastener.

12 Claims, 5 Drawing Sheets

CAP WITH APERTURE

RELATED APPLICATIONS

Not applicable.

FIELD OF THE INVENTION

The present invention relates generally to a cap having an aperture and more specifically relates to apertures which facilitate hair to project therethrough.

BACKGROUND OF THE INVENTION

The industries relating to personal style and fashion are constantly growing and evolving. People are continually striving to create and maintain their personal look, style and identity while keeping in tune with the latest trends as they hit the fashion scene. Among the many facets of which these multi-million-dollar trades are comprised, the field of accessories is one of the most prominent. And a very important part of this fashion accessory market is that of baseball caps.

Such caps cover the gamut from sport teams, fashion designers, company logos, and even hats that are distressed to look years old. However, those people with ponytails or other styles of gathered hair cannot wear baseball caps due to the increased size of their hair and head as defined by the gathered mass of hair. If the hat should be forced on, the hair runs the risk of becoming smashed. Also, many gathered hairstyles are worn by kids who, ironically, need the protection of a baseball cap from the sun and other elements. Accordingly, there is a need for baseball caps which accommodate wearers with gathered hair styles such as ponytails. The development of the sport cap with hair aperture fulfills this need.

SUMMARY OF THE INVENTION

The principles of the present invention provide for a cap, comprising a cap which has a portion having a plurality of panels that are connected by a plurality of stitching to form a hemispherical shape. The panels have a plurality of lower extremes and a plurality of upper extremes. The cap also comprises a visor, a sweatband provided at the lower extremes of the panels to form a brim, a plurality of size adjustment mechanisms adjusting the sports cap size and a center opening located at a center portion of the panels. The center opening is bordered by a concealed elastic that is hemmed into the center portion of each of the panels. The panels are used to rout a wearer's hair from an interior of the sports cap allowing for a tight and secure fit of the sport cap upon the wearer's head. The visor is located directly opposite a rear gap. The rear gap provides an open continuous pathway from the center opening to the sweatband.

The sport cap also may comprise a plurality of eyelets which are provided near the upper extremes of the panels. The rear gap may be held in a closed state. The rear gap may be held in the closed state via three or more straps that are each secured by a hook-and-loop-type fastener. The hook-and-loop-type fasteners may also allow for customization of the fit of the sport cap by allowing minor variation of the circumference of the sweatband as well as the overall surface area of the cap portion.

The rear gap may be held in the closed state via a closure flap which overlaps on the panels on the opposite side of the rear gap. The closure flap may be held in place by at least four sections of a first hook-and-loop-type fastener half on the underside of the closure flap that secures to a matching second hook-and-loop-type fastener half located on the outer face of the opposite panel. The wearer's hair may be routed through the center opening such that it is external to the sport cap and allows the cap portion to fit close to the head.

A logo and or indicia area may be provided above the visor. The sweatband may be elastic or non-elastic and fixed. The size adjustment mechanisms may be selected from the group consisting of a plurality of plastic strips, a plurality of elastic bands, a plurality of straps, a plurality of buckles, or a plurality of hook and loop fasteners.

The panels may be used to rout the wearer's hair from an interior of the sports cap allowing for a tight and secure fit of the sport cap upon the wearer's head. The wearer of the cap could place the sport cap on their head in the normal position, then reach through the center opening and grab his or her hair and pull it through the center opening. The center opening may be one and one-half inches in diameter. The wearer's hair may be placed in a pre-arranged type of collection such as a ponytail, bun or man bun.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
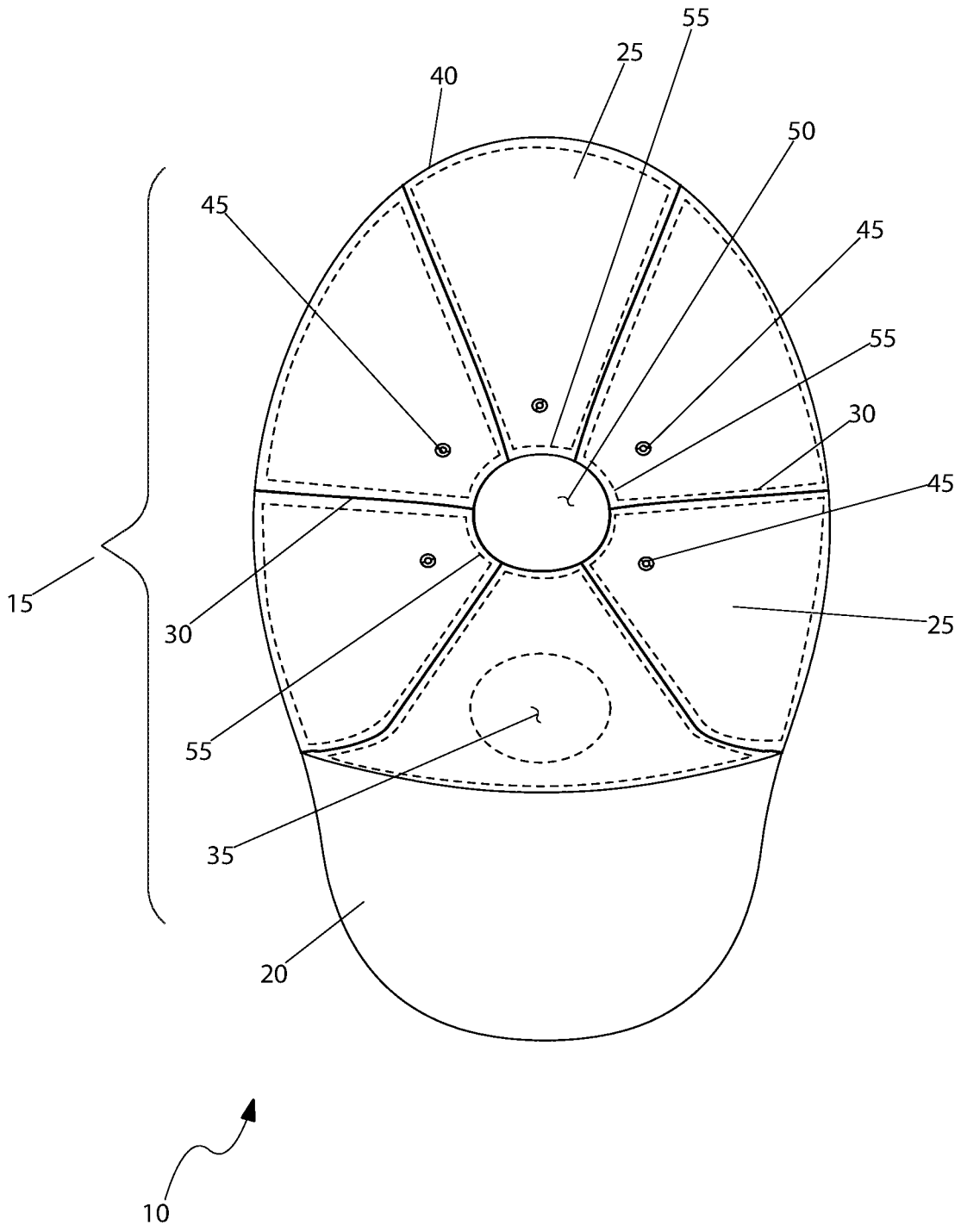
FIG. 1 is a top view of the sport cap 10, according to a preferred embodiment of the present invention.

10 sport cap
15 cap portion
20 visor
25 panel
30 stitching
35 logo indicia
40 sweatband
45 eyelet
50 center opening
55 concealed elastic
60 hair
65 wearer
70 head
75 rear gap
80 straps
85 hook-and-loop-type fastener
90 closure flap
95 first fastener half
100 second fastener half

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a top view of the sport cap 10, according to the preferred embodiment of the present invention is disclosed. The sport cap (herein also described as the "sport cap") 10, includes a cap portion 15 and a visor 20 as is customarily expected. The cap portion 15 comprises multiple panels 25 that are physically connected by stitching 30 to form its customary hemispherical shape. A logo indicia 35 area may or may not be provided above the visor 20 and a sweatband 40 is provided at the lower extremes of the panels 25 thus forming the brim. Additionally, eyelets may or may not be provided near the upper extremes of the panels 25. It is understood that the sport cap 10 may be made available in a wide variety of sizes, colors, fabrics, styles, and with a wide variety of decorative graphical elements. Also, the sport cap 10 may be made available with a wide variety of size adjustment mechanisms such as plastic strips, elastic, straps, buckles, hook and loop fastener, and the like. As such, the inclusion or exclusion of any such variations and features is not intended to be a limiting factor of the present invention.

A center opening 50 is located at the center or uppermost portion of the panels 25. The center opening 50 may be bordered by concealed elastic 55 that is hemmed into the upper portion of each panel 25. The center opening 50 is envisioned to be approximately one and one-half inches (1½ in.) in diameter, although other sizes, depending on the specific variation of the cap 10 are also possible. As such, the size and positioning of the center opening 50 are not intended to be a limiting factor of the present invention. The panels 25 would be used to rout the hair 60 (not shown) of the wearer 65 (not shown) from the interior of the cap 10 to the cap 10 allowing for a tight and secure fit of the cap 10 upon the head 70 (not shown).

Figure 2:
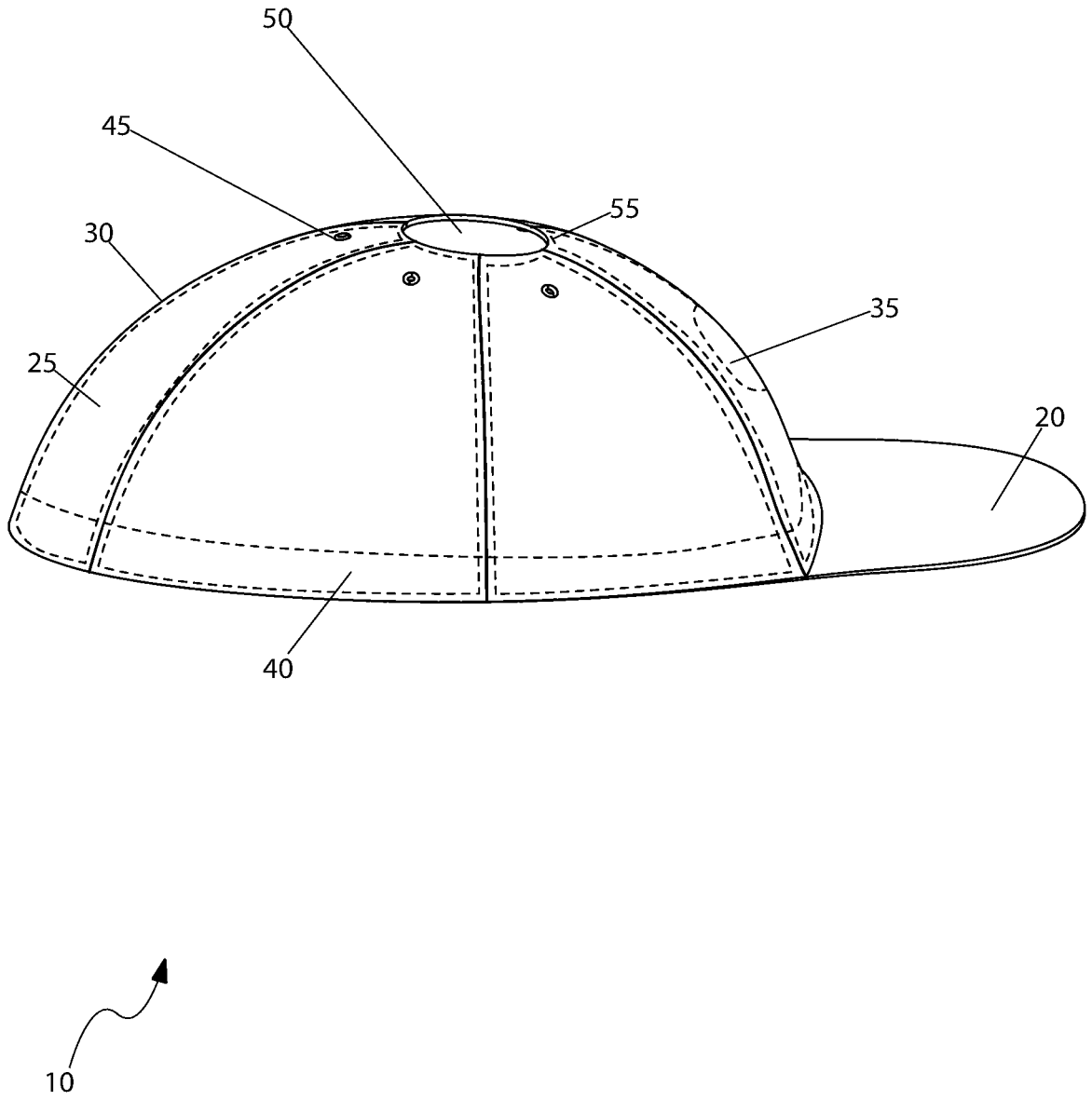
FIG. 2 is a side view of the sport cap 10, according to the preferred embodiment of the present invention.

Referring next to FIG. 2, a side view of the sport cap 10, according to the preferred embodiment of the present invention is depicted. This view provides clarification on the placement of the center opening 50, with the optional concealed elastic 55, atop the panels 25. The sweatband 40 (shown via a hidden line due to its concealed nature). As expected, the eyelets 45, the logo indicia 35, the stitching 30 and the visor 20 are visible as well. The sweatband 40 may be of an elastic nature or fixed depending on the specific make. During application of the sport cap 10 the wearer 65 (not shown) would place the sport cap 10 on their head 70 (not shown) in the normal position, then reach through the center opening 50 and grab their hair 60 (not shown) which was placed in a ponytail, bun, or other pre-arranged type of collection and pull it through the center opening 50.

Figure 3:
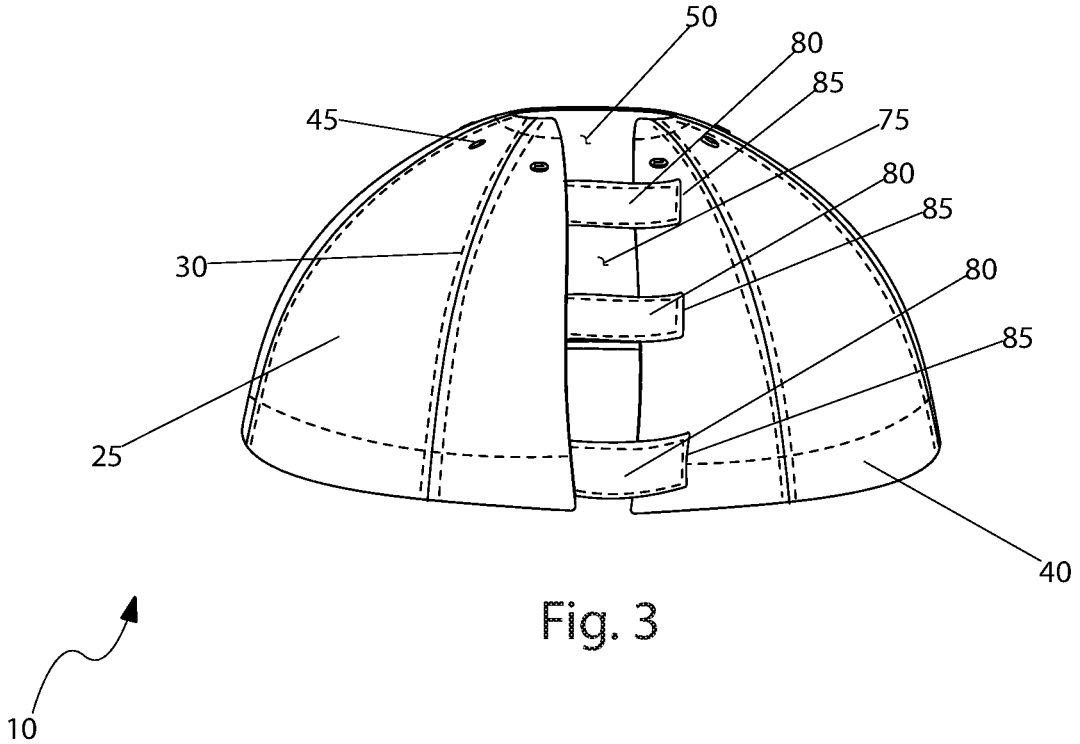
FIG. 3 is a rear view of the sport cap 10, according to an alternate embodiment of the present invention.

Referring now to FIG. 3, a rear view of the sport cap 10, according to an alternate embodiment of the present invention is shown. This arrangement provides for an alternative method of placement other than that aforementioned described in FIG. 2. The alternate embodiment provides for the panels 25, the stitching 30, the eyelets 45, arranged in a similar manner to that of FIG. 1 and FIG. 2. It is noted that the visor 20 (not shown in this figure due to illustrative limitations) is located directly opposite a rear gap 75. The rear gap 75 provides an open continuous pathway from the center opening 50 to the sweatband 40. In such a manner, the sport cap 10 may be applied around a ponytail, bun, or other pre-arranged type of collection of hair 60 (not shown) as the sport cap 10 is applied to the head 70 (not shown) of the wearer 65 (not shown). The rear gap 75 is held in a closed state via three (3) or more straps 80 that are secured by hook-and-loop-type fastener 85. It is noted that the hook-and-loop-type fastener 85 also allows for customization of the fit of the sport cap 10 by allowing minor variation of the circumference of the sweatband 40 as well as the overall surface area of the cap portion 15.

Figure 4:
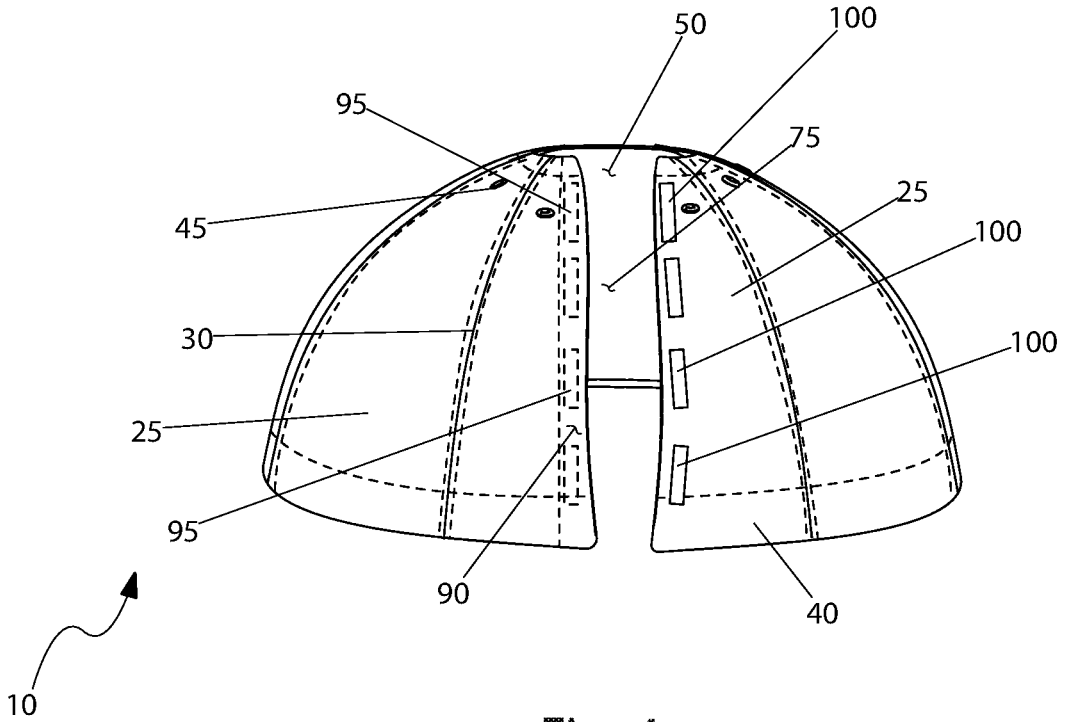
FIG. 4 is a rear view of the sport cap 10, according to yet another alternate embodiment of the present invention.

Referring next to FIG. 4, a rear view of the sport cap 10, according to a yet another alternate embodiment of the present invention is disclosed. This arrangement provides for yet another alternative method of placement other than that aforementioned described in FIG. 2 and FIG. 3. This alternate embodiment provides for the panel) 25, the stitching 30, the eyelets 45, arranged in a similar manner to that of FIG. 1 FIG. 2, and FIG. 3. It is noted that the visor 20 (not shown in this figure due to illustrative limitations) is located directly opposite a rear gap 75. The rear gap 75 provides an open continuous pathway from the center opening 50 to the sweatband 40. In such a manner, the sport cap 10 may be applied around a ponytail, bun, or other pre-arranged type of collection of hair 60 (not shown) as the sport cap 10 is applied to the head 70 (not shown) of the wearer 65 (not shown). The rear gap 75 is held in a closed state via a closure flap 90 which overlaps on the panels 25 on the opposite side of the rear gap 75. The closure flap 90 is held in place by at least four (4) sections of a first fastener half 95 (shown by hidden lines due to its hidden state) on the underside of the closure flap 90 that secures to the matching second fastener half 100 located on the outer face of the opposite panel 25. As such, in a manner similar to that disclosed in FIG. 3, customization of the fit of the sport cap 10 by allowing minor variation of the circumference of the sweatband 40 as well as the overall surface area of the cap portion 15 is possible with this embodiment as well. The first fastener half 95 and second fastener half 100 are preferably either mating halves of a typical hook-and-loop-type fastener.

Figure 5:
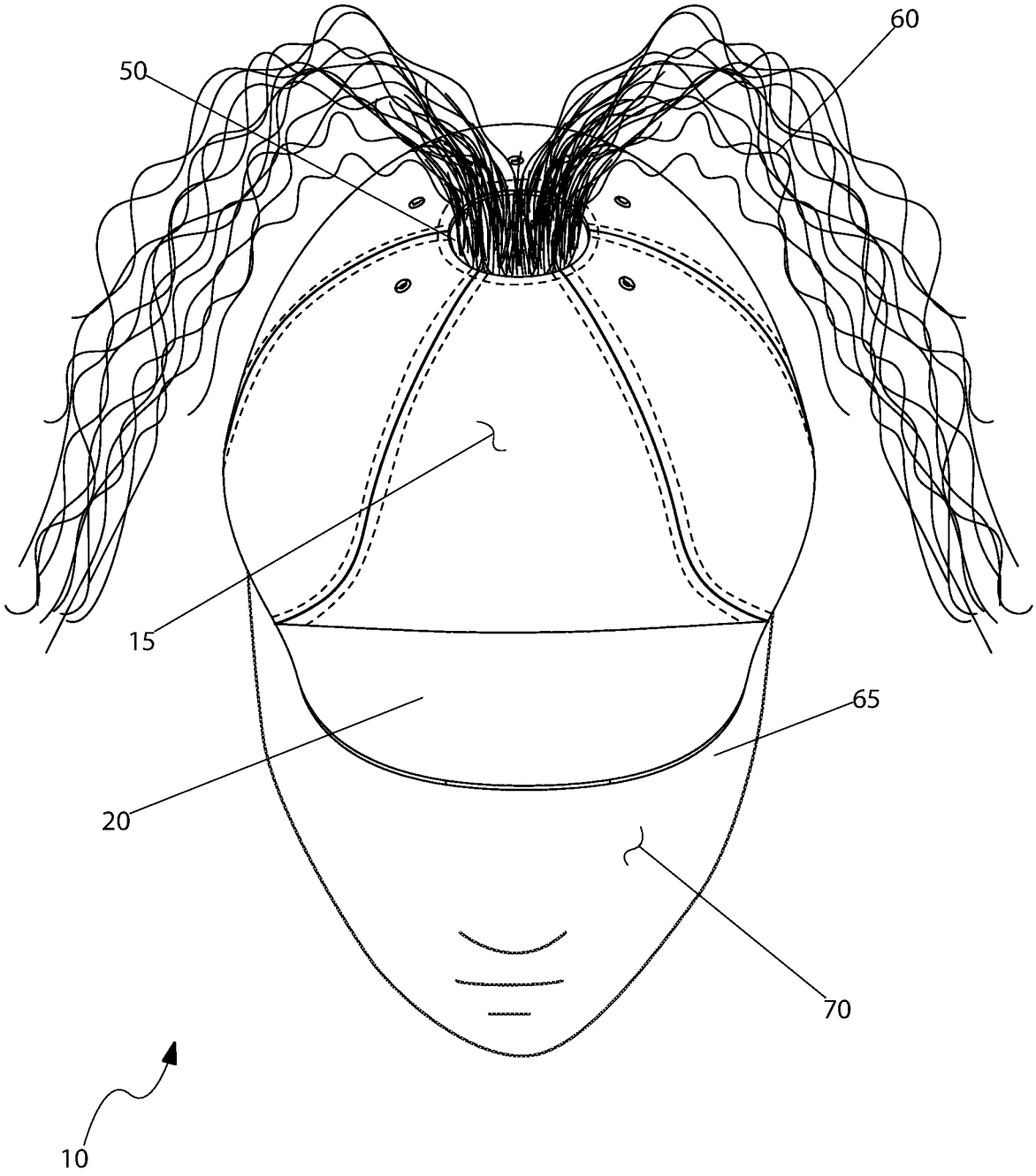
FIG. 5 is a front view of the sport cap 10, shown in a utilized state, according to the preferred embodiment of the present invention; and, FIG. 6 is a side view of the sport cap 10, shown in a utilized state, according to the preferred embodiment of the present invention.

Referring now to FIG. 5, a front view of the sport cap 10, shown in a utilized state, according to the preferred embodiment of the present invention is depicted. The wearer 65 wears the sport cap 10 atop their head 70 in a customary position. Their hair 60 is routed through the center opening 50 such that it is external to the sport cap 10 and allows the cap portion 15 to fit close to the head 70. Additionally, the exposed hair 60 provides an aesthetically pleasing appearance allowing for display of styled hair while still affording the wearer 65 protection from the elements as well as providing shade via the visor 20.

Figure 6:
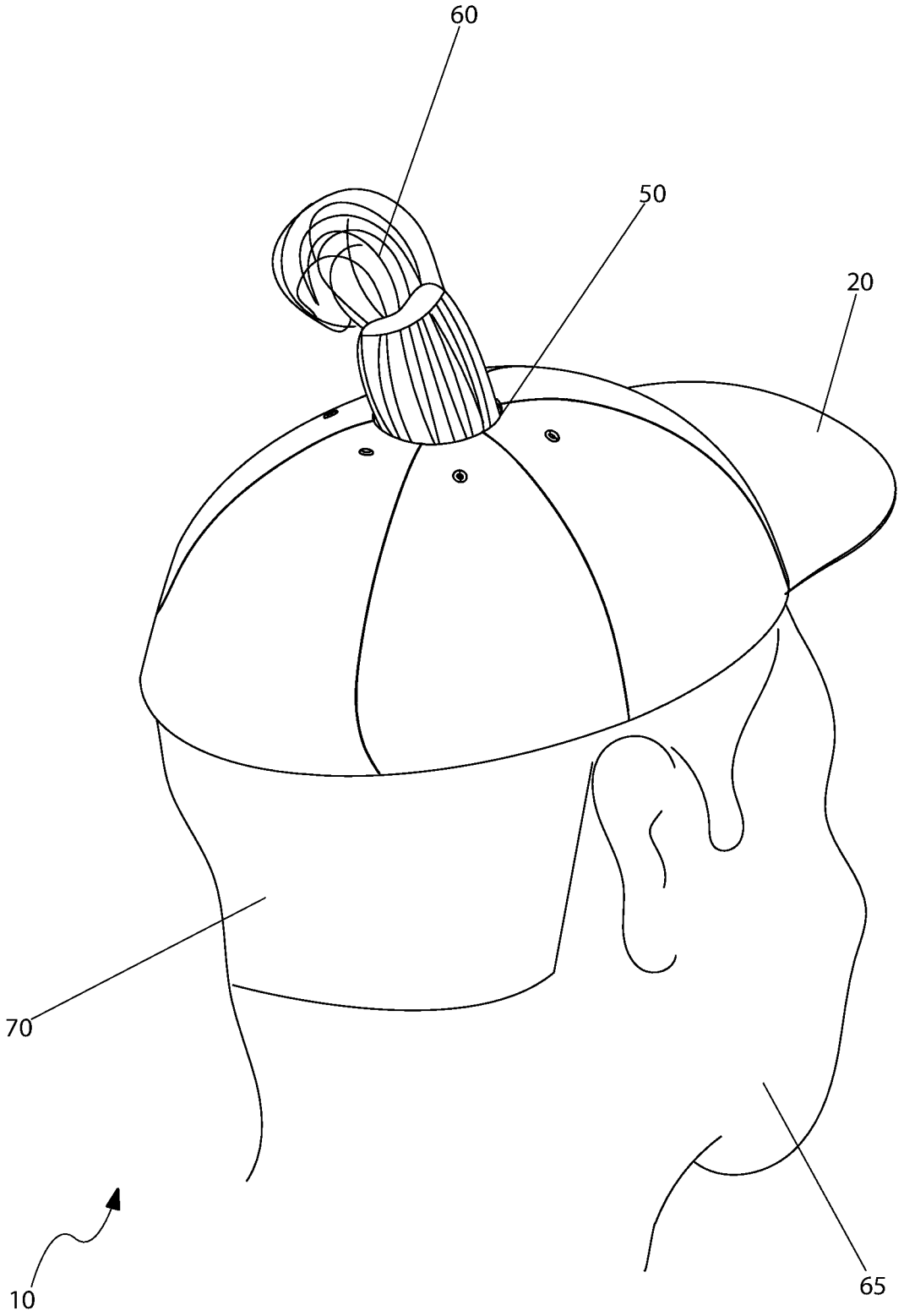

Referring to FIG. 6, a side view of the sport cap 10, shown in a utilized state, according to the preferred embodiment of the present invention is shown. The hair 60 of the wearer 65, here depicted as a bun, is routed through the center opening 50 while the sport cap 10 fits upon the head 70 in a tight manner. As expected, the visor 20 provides shade for the wearer 65.

2. Operation of the Preferred Embodiment

The preferred embodiment of the present invention can be utilized by the common wearer 65 in a simple and effortless manner with little or no training. It is envisioned that the sport cap 10 would be constructed in general accordance with FIG. 1 through FIG. 6. The wearer 65 would procure the sport cap 10 from conventional procurement sources such as department stores, clothing sports, sporting good stores, mail order stores, internet supply sources and the like. Special attention would be paid to size, color, style, decorative elements, adjustment mechanism, and the like.

After procurement and prior to utilization, the sport cap 10 would be prepared in the following manner: the wearer 65 would place their hair 60 in a specific style that routs excess hair in a group near the top of the head 70 such as a ponytail, bun, or other pre-arranged type of collected hair 60.

During utilization of the sport cap 10, the following procedure would be initiated: in the case of the embodiment as shown in FIG. 1 and FIG. 2, the wearer 65 would place the cap 10 on their head 70 in the normal position, then reach through the center opening 50 and grab their hair 60 which was previously styled and pull it through the center opening 50. In the case of the two (2) alternate embodiments as shown in FIG. 3 and FIG. 4, the wearer 65 separates the hook-and-loop-type fastener 85, or the first fastener half 95 and the matching opposite second fastener half 100 and places the rear gap 75 around the hair 60 as the cap portion 15 is placed upon the head 70. The hook-and-loop-type fastener 85 or the first fastener half 95 and the matching opposite second fastener half 100 is rejoined to complete the assembly and fitting.

After use of the sport cap 10, it is simply removed following the reverse of the above described processes and stored until needed again in circular usage pattern.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A cap, comprising:

a cap portion having a plurality of panels that are connected by a plurality of stitching to form a hemispherical shape, the panels having a plurality of lower extremes and a plurality of upper extremes;

a visor;

a sweatband provided at the lower extremes of the panels to form a brim;

a plurality of size adjustment mechanisms adjusting the cap size;

a center opening located at a center portion of the panels, the center opening bordered by a concealed elastic that is hemmed into the center portion of each of the panels, the panels are used to rout a wearer's hair from an interior of the cap allowing for a tight and secure fit of the cap upon the wearer's head; and a logo indicia disposed above the visor;

wherein the visor is located directly opposite a rear gap, the rear gap provides an open continuous pathway from the center opening to the sweatbands;

wherein the rear gap is held in a closed state;

wherein the rear gap is held in the closed state via three or more straps that are each secured by a hook-and-loop-type fastener; and wherein the hook-and-loop-type fasteners also allows for customization fit of the cap by allowing variation of a circumference of the sweatband as well as the overall surface area of the cap portion.

2. The cap according to claim 1, further comprising a plurality of eyelets are provided near the upper extremes of the panels.

3. The cap according to claim 1, wherein the wearer's hair is routed through the center opening such that it is external to the cap and allows the cap portion to fit close to the head.

4. The cap to claim 1, wherein the sweatband is elastic.

5. The cap according to claim 1, wherein the sweatband is non-elastic and fixed.

6. The cap according to claim 1, wherein the size adjustment mechanisms are selected from the group consisting of a plurality of plastic strips, a plurality of elastic bands, a plurality of straps, a plurality of buckles, or a plurality of hook and loop fasteners.

7. The cap according to claim 1, wherein the panels are used to rout the wearer's hair from an interior of the sports cap allowing for a tight and secure fit of the cap upon the wearer's head.

8. The cap according to claim 1, wherein during application of the cap, the wearer places the cap on their head, then reach through the center opening and grab their hair and pull it through the center opening.

9. The cap according to claim 1, wherein the center opening is one and one-half inches in diameter.

10. The cap according to claim 1, wherein the wearer's hair is placed in a pre-arranged type of collection.

11. The cap according to claim 10, wherein the wearer's hair is placed in a ponytail.

12. The cap according to claim 10, wherein the wearer's hair is placed in a bun.

* * * * *